United States Patent [19]

Beneke et al.

[11] 4,295,248

[45] Oct. 20, 1981

[54] CARDING WIRE BRUSH ARRANGEMENT

[75] Inventors: Wolfgang Beneke; Paul Teichmann, both of Monchen-Gladbach, Fed. Rep. of Germany

[73] Assignee: Trutzschler GmbH & Co. KG, Monchen-Gladbach, Fed. Rep. of Germany

[21] Appl. No.: 46,789

[22] Filed: Jun. 8, 1979

[30] Foreign Application Priority Data

Jun. 10, 1978 [DE] Fed. Rep. of Germany ..... 2825506

[51] Int. Cl.[3] ..... D01G 15/24

[52] U.S. Cl. ..... 19/113

[58] Field of Search ..... 19/97, 107, 113, 114, 19/110, 111

[56] References Cited

U.S. PATENT DOCUMENTS 3,290,729 12/1966 Maynard ..... 19/114

4,074,392 2/1978 Bechtel ..... 19/113

FOREIGN PATENT DOCUMENTS 1106653 5/1961 Fed. Rep. of Germany ..... 19/113

*Primary Examiner*—Louis Rimrodt

*Attorney, Agent, or Firm*—Haseltine and Lake

[57] ABSTRACT

A carding wire brush, particularly for revolving flats, with hook-like brush elements which are inserted in a carrying layer and protrude from the carrying layer to form the carding teeth. The tooth face of the carding teeth forms a nearly right or obtuse angle relative to the carrying layer. The tooth flank is chamfered or bent concavely in relation to the carrying layer. The tip region of the carding teeth is nearly parallel to the carrying layer. Polyvinyl chloride may be used as the carrying layer, and tooth flank may be tangent to the carrying layer. The tip region of the carding teeth is at least 10% of the side length of the base wire cross section. The carding wire brush may be used as fixed breakup element underneath the lickerin on the carding machine or above the lickerin on the drum of the carding machine. The carding wire brush may also be used for revolving flats arranged alternately with carding wire brushes having pointed teeth.

10 Claims, 3 Drawing Figures

CARDING WIRE BRUSH ARRANGEMENT

BACKGROUND OF THE INVENTION

The present invention relates to a carding wire brush particularly the wire brush of revolving flats, with hook-like brush elements which are placed into a carrying layer and project from the carrying layer to form the carding teeth.

A known carding wire brush consists of a multi-layer base into which teeth are inserted which protrude from the base to form the carding teeth, but are so short that the tendency of the teeth to retain scrap fiber is as small as possible. However, the angle between face side and base is smaller than 90°, so that the fiber and waste accumulate around the carding tooth. With this carding wire brush, the projecting part of each wire has a wire tip which is subject to high wear. Also, the tip may bend under high loads. Furthermore, this carding wire brush is not suitable for preliminary breakup where fiber flakes are to be only held back and broken up.

Accordingly, it is an object of the present invention to provide a carding wire brush which is free of the above disadvantages, in which no scrap fiber accumulates, with carding teeth being wear-resistant and bend-resistant and which is suitable for a breakup segment.

Another object of the present invention is to provide an arrangement of the foregoing character which is substantially simple in construction and may be economically fabricated.

A further object of the present invention is to provide a carding wire brush, as described, which may be readily maintained in service and which has a substantially long operating life.

SUMMARY OF THE INVENTION

The objects of the present invention are achieved by having the tooth face of the carding teeth form a nearly right or obtuse angle with the carrying layer, that the tooth flank is chamfered or bent concavely in relation to the carrying layer and that the tip region of the carding teeth is nearly parallel to the carrying layer.

Because the tooth face forms a nearly right or obtuse angle, scrap and waste fibers which get stuck between the teeth of the carding wire brush, slide along the tooth face in the direction of the opposite carding element to prevent these scrap and waste fibers from accumulating in front of the tooth face. Hence, this design of the tooth face has the advantage that cleaning the carding wire brush is not required. The tooth flank may be concave or taper from the rear edge of the tip region as straight line towards the carrying layer, with the end of the tooth flank meeting the brush wire width at the carrying layer level. This design of the tooth flank assists the sliding-off of the waste fibers from the carding teeth. At the same time, the tip region of the tooth, which serves to dig into the fiber flakes, is shortened and thus become more effective. This region would be increased by a concave bending of the tooth flank. The carding teeth have an elongate shape, with an extended tip region and therefore, in contrast with the known carding arrangement with a pointed tooth, are wear- and bend-resistant. Furthermore, the wire carding brush in accordance with the present invention is suitable for a preliminary break-up element which merely retains and breaks up the fiber flake layer, with the parallel alignment of the individual fibers following. The result of the geometric design is a carding wire brush whose carding teeth are wear- and bend-resistant, where no scrap fibers accumulate and suitable as preliminary break-up element. The carding wire brush can be produced simply by sticking the hook-like carding elements through an elastic carrying layer.

The carrying layer may be made of textile rubber, preferably polyvinyl chloride or similar materials. Preferably the tooth flank is tangent to the carrying layer. The tooth tip should be at least 10% of the side length of the cross section of the base wire. This cross section of the base wire may be rectangular, oval or round.

The carding wire brush of the present invention is used to advantage for a fixed preliminary breakup segment below the lickerin. It also may be advantageous to use the carding wire comb for a carding element located on the drum of the carding machine above the lickerin. In accordance with another advantageous application, the carding wire comb is used for revolving flats or fixed flats alternately with carding combs with pointed teeth.

The novel features which are considered as characteristic for the invention are set forth, in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
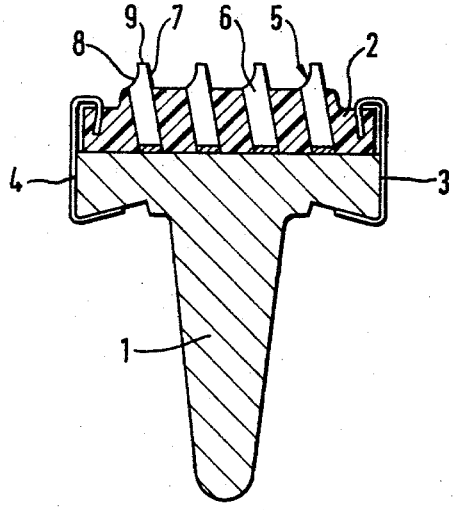
FIG. 1 shows a cross section of a carding wire brush on a revolving flat
Figure 2:
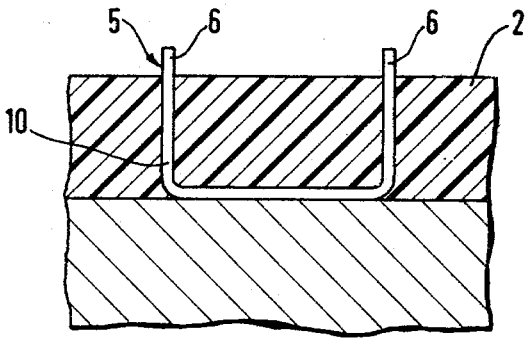
FIG. 2 shows a hook-like wire comb element of the carding brush in a carrying layer.
Figure 3:
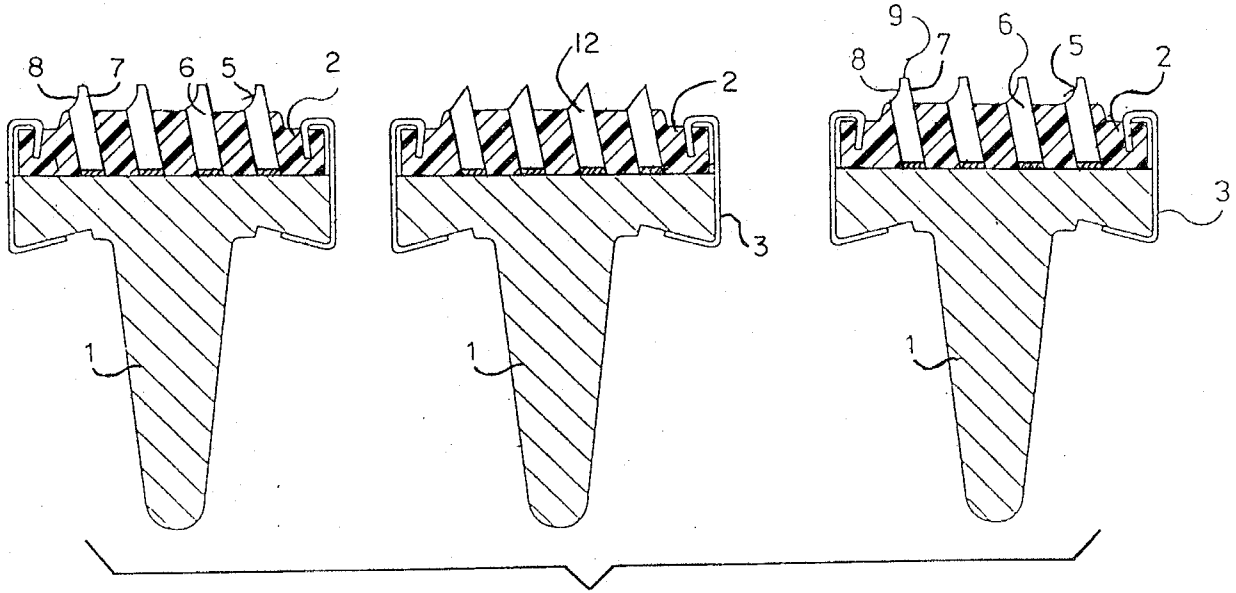
FIG. 3 shows a cross section of a carding wire brush with revolving flats and fixed flats, in accordance with another embodiment of the present invention.

FIG. 1 shows a cross section of a revolving flat of a carding machine. A carrying layer 2 is clamped by side clamps 3, 4 onto a revolving flat. In the carrying layer 2 a plurality of hook-like wire brush elements 5 are placed at intervals. They protrude from the carrying layer 2 to form the carding teeth 6. The hook-like wire comb elements 5 are bent U-shaped (see FIG. 2) and arranged at intervals. The carding teeth 6 have a tooth face 7 which forms an obtuse angle larger than 90° with the carrying layer. The tooth flank 8 is chamfered and bent concavely in relation to the carrying layer 2. The tip region 9 of the carding tooth 6 is nearly parallel to the carrying layer 2. In another embodiment, shown in FIG. 3, there are provided revolving flats and fixed flats, with the carding wire brushes operating alternately with carding wire brushes having pointed carding teeth 12th.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A carding wire brush, particularly for revolving flats, comprising: a carrying layer, hooklike brush elements inserted into said carrying layer and protruding from said carrying layer to form carding teeth, said carding teeth having tooth faces forming an angle larger than 90° with said carrying layer, said carding teeth having tooth flanks chamfered and curved concavely in relation to said carrying layer; said carding teeth having tip regions substantially parallel to said carrying layer.

2. A carding wire brush as defined in claim 1 wherein said carrying layer is made of polyvinyl chloride.

3. A carding wire brush as defined in claim 1 wherein said tooth flanks are tangent to said carrying layer.

4. A carding wire brush as defined in claim 1 wherein said tip regions of said carding teeth measure at least 10% of a side length of a cross section of base wire forming said carding teeth.

5. A carding wire brush as defined in claim 1 including a fixed breakup element and a lickerin, said carding wire brush comprising a fixed breakup element underneath said lickerin on a carding machine.

6. A carding wire brush as defined in claim 1 including a fixed breakup element and a lickerin, said carding wire brush comprising a fixed breakup element above said lickerin on a drum of a carding machine.

7. A carding wire brush as defined in claim 1 including revolving flats and fixed flats, said carding wire brushes being arranged alternately with carding wire brushes having pointed carding teeth.

8. A carding wire brush as defined in claim 1, wherein said carrying layer is made of polyvinyl chloride, said tooth flanks being tangent to said carrying layer, said tip regions of said carding teeth measuring at least 10% of a side length of a cross section of base wire forming said carding teeth.

9. A carding wire brush as defined in claim 1, said carrying layer is made of polyvinyl chloride, said tooth flanks being tangent to said carrying layer, said tip regions of said carding teeth measuring at least 10% of a side length of a cross section of base wire forming said carding teeth, a fixed breakup element and a lickerin, said carding wire brush comprising a fixed breakup element underneath said lickerin on a carding machine, revolving flats and fixed flats, said carding wire brushes operating alternately with carding wire brushes operating alternately with carding wire brushes having pointed carding teeth.

10. A carding wire brush as defined in claim 1, said carrying layer is made of polyvinyl chloride, said tooth flanks being tangent to said carrying layer, said tip regions of said carding teeth measuring at least 10% of a side length of a cross section of base wire forming said carding teeth, a fixed breakup element and a lickerin, said carding wire brush comprising a fixed breakup element above said lickerin on a drum of a carding machine, revolving flats and fixed flats, said carding wire brushes operating alternately with carding wire brushes having pointed carding teeth.

* * * * *